United States Patent [19]

Gordin

[11] Patent Number: 4,994,718

[45] Date of Patent: Feb. 19, 1991

[54] METHOD AND MEANS FOR DIMMING BALLASTED LAMPS

[75] Inventor: Myron K. Gordin, Oskaloosa, Iowa

[73] Assignee: Musco Corporation, Oskaloosa, Iowa

[21] Appl. No.: 308,107

[22] Filed: Feb. 7, 1989

[51] Int. Cl.[5] ..... H05B 37/00

[52] U.S. Cl. ..... 315/240; 315/320; 315/DIG. 4

[58] Field of Search ..... 315/240, 312, 313, DIG. 4, 315/241 R, 320

[56] References Cited

U.S. PATENT DOCUMENTS

| | | | |
|---|---|---|---|
| Re. 31,146 | 2/1983 | Gyursanszky | 315/276 |
| 3,323,013 | 5/1967 | Lord | 315/187 |
| 3,893,002 | 7/1975 | Woodnutt | 315/291 |
| 3,911,320 | 10/1975 | Crawford et al. | 315/240 |
| 3,935,505 | 1/1976 | Spiteri | 315/194 |
| 4,348,612 | 9/1982 | Morton | 315/58 |
| 4,353,009 | 10/1982 | Knoll | 315/220 |
| 4,414,493 | 11/1983 | Henrich | 315/308 |
| 4,559,479 | 12/1985 | Munson | 315/239 |
| 4,612,478 | 9/1986 | Payne | 315/176 |

*Primary Examiner*—Robert J. Pascal

*Attorney, Agent, or Firm*—Zarley, McKee, Thomte, Voorhees & Sease

[57] ABSTRACT

A means and method for dimming ballasted lamps ensures that sufficient starting voltage is always available to the ballasted lamps, yet allows switching between maximum light output, and one or more dimmed light output levels. Each lamp is connected to a ballast and has a capacitor component in parallel between the ballast and the lamp. A selection or switching device allows control of the desired light output level. For dimmed light output levels, the selection device causes a reduction in capacitance of the capacitance component to reduce the power to each of the lamps. An optional timing device ensures that full capacitance will always be available during starting. Once the selected timing period of the timing device is expired, the selected light level is achieved by automatically changing the capacitance available to each lamp to alter the output of that lamp. The selection or switching device can control a single lamp, or an array of lamps, or multiple arrays of lamps at spaced apart locations.

31 Claims, 3 Drawing Sheets

| LOGIC: | | |
|---|---|---|
| TD RELAY 58 | KEY SWITCH 60 | LAMPS 26 |
| NORMAL | HIGH | NORMAL |
| NORMAL | LOW | NORMAL |
| ON | HIGH | NORMAL |
| ON | LOW | DIM |

METHOD AND MEANS FOR DIMMING BALLASTED LAMPS

BACKGROUND OF THE INVENTION

A. Field of the Invention

The present invention relates to a means and method for dimming ballasted lamps, and in particular, relates to a means and method for changing light output from a lamp or lamps by adjusting the ballast for a lamp or an array of lamps.

B. Problems in the Art

Many types of lamps, particularly those used for wide scale and high intensity lighting, utilize ballasts for providing sufficient starting power to the lamps and at the same time preventing current run-away through the lamp. They are also beneficial to maintain the stability for a lamp or an array of lamps.

It is therefore necessary to match the specification of the ballast to the particular lamp or array of lamps to allow the ballast to achieve its particular functions. The lamp or array of lamps can thus be controlled to turn on efficiently, and operate in an efficient and stable manner.

There are numerous times, however, when it would be desirable or beneficial to be able to achieve different light levels out of one lamp or an array of lamps. For example, for wide area, high powered arrays of lamps utilized to light tennis courts, it can be desirable to have easy and efficient starting and operation of those lights. It can then be desirable to dim those lights for those tennis courts when they are not being used. It might also be desirable to be able to use some lights at full intensity, but have other lights which are not directly needed for use to be dimmed (such as those on unused courts). Those lights would then serve to provide low level illumination for persons walking to or past those tennis courts and be quickly available to be operated at full intensity when those particular courts are to be used.

Because lamps of these types often take considerable time to start, it can be beneficial to have the lights in at least the dimmed condition so that they can be quickly brought to full light output, rather than started cold, or restarted. It is to be understood that to allow dimming would realize a savings in energy, over and against operating the lamps at full power all the time. It may also contribute to longer lamp-life, depending on what type and power of lamp is used.

It is to be further understood that other examples of the need for such lighting are numerous, including but not limited to, other types of sports lighting (both indoor and outdoor), intermittent special events lighting, timed period lighting, and the like. It would be advantageous to be able to adjust the lighting between full intensity and dimmed intensity. It may also be advantageous to be able to adjust the lights between a plurality of different lighting levels. Thus, one set of wide area, high intensity lamps could be used for different purposes.

Some attempts have been made to allow for dimming of ballasted lamps. Many of these methods are either complex or expensive, or result in instability of the lighting when switched to the dimmer intensity. Instability can cause flutter or color change in the light, both of which are generally undesirable.

Another problem with some of these methods is that they require a dimming system for each lamp. This is not only costly, but necessarily involves the operation of dimming means on an individual fixture basis, rather than on the more efficient and controllable multi-lamp method.

It would simply be too uneconomical to have lighting fixtures which contain different powered lamps for different light outputs. Presently attempted methods are not completely successful in solving the above mentioned problems. It is to be understood that present methods also have the problem of many times being able to dim the lamps effectively by changing the input voltage of the ballast for each lamp, but this can result in having insufficient voltage to start the lamp or lamps, particularly in cold weather conditions.

There is no current economical, efficient, and reliable multilevel light output means or method for ballasted lamps. There is therefore a real need in the art for such an improvement.

There are also certain needs whereby it would be advantageous to have automatic dimming of lighting, when full intensity lighting is not needed. This could be advantageous for indoor sports lighting, such as gymnasiums, where a certain level of lighting intensity below full intensity could be utilized when the playing field or court is not in use. It could also be applied to lighting whereby if full intensity lighting is used for a period of time, the lighting would automatically dim unless instructed otherwise. This would save energy and could save bulb life. Such a system could also be used to notify a spectator audience of the end or beginning of events; such as different periods of an athletic contest, or different races at a horse racing track, etc.

It is therefore the principle object of the present invention to provide a means and method for dimming ballasted lamps which improves over or solves the problems and deficiencies in the art.

Another object of the present invention is to provide a means and method as above described which allows constant and adequate electrical power for starting ballasted lamps, while at the same time allowing for selection between full lighting intensity and one or more dimmed levels.

A further object of the present invention is to provide a means and method as above described which insures sufficient starting power, even when the lamp or lamps are switched to a dimmed level.

A still further object of the present invention is to provide a means and method as above described which does not produce unacceptable instability or color change in the output of the lamps.

Another object of the present invention is to provide a means and method as above described which can provide dimming for one lamp, a plurality of lamps, or a plurality of arrays of lamps.

A further object of the present invention is to provide a means and method as above described which can easily be incorporated into newly constructed lighting fixtures or arrays, or which can be easily retrofitted to existing lighting fixtures or arrays, and which can be used for either indoor or outdoor lighting applications.

Another object of the present invention is to provide a means and method as above described which can, in certain situations, beneficially effect and prolong lamp life.

Another object of the present invention is to provide a means and method as above described which can assist in savings of energy and power consumption.

A further object of the present invention is to provide a means and method as above described which is economical to manufacture, assemble, maintain, and service.

Another object of the present invention is to provide a means and method as above described which is efficient, reliable, and durable.

These and other objects, features, and advantages of the invention will become more apparent with reference to the accompanying specifications and claims.

SUMMARY OF THE INVENTION

The present invention includes a means and method for dimming ballasted lamps. The method consists of selecting between various desired light output levels, by means of a control switch or means. Sufficient voltage for starting each lamp is always supplied to each lamp. At the same time, sufficient current is always supplied to each lamp for starting. It is important that sufficient power be supplied to the lamps for starting.

A switching means or control means is utilized to allow selection of a desired light output level. Once started, the appropriate voltage and current is supplied to each lamp to provide for the selected light output. The switching or control means is utilized to alter the power supplied to the lamps. For example, if a lower light output is desired, the switch means is turned to a lower light output position, and power is reduced to the level for the particular selected light output.

By altering the selection of desired light output, power to the lamps is adjusted accordingly to correlate selection with the actual light output.

The means of the invention provides structure to facilitate the method of the invention. One or more lamp means each are each operatively connected to a ballast or auto- transformer circuit which provides constant starting voltage. Each lamp is also operatively connected to capacitor means which is utilized to prevent current run away (a current limiter), and which also contributes to determine the amount of power supplied to each lamp.

Electrical power to each lamp is supplied through the ballast from a fused electrical power source. Starting voltage is always, therefore, kept constant.

In order to control the lighting output level of each lamp, the capacitor means is variable to correspondingly control power sent to operate each lamp. The switching or control means is utilized to select the level of capacitance presented to each lamp circuit. For a two-level lighting output, two levels of capacitance would be available. For higher light output, a higher capacitance would be selected. Conversely, for lower light output, capacitance would be removed from each lamp circuit.

Thus, for example, for full light output for a particular lamp, the proper capacitance for appropriate current limiting and the provision of sufficient electrical power for full lighting output is provided to each lamp, such as is well known in the art. However, if a dimmed light output condition is desired, the circuitry has a provision for removing a quantity of capacitance from each lamp circuit. Upon removal of that capacitance, less power will be provided to each lamp which will result in less light output.

If more than one dimmed level is desired, third, fourth, etc. capacitance levels can be incorporated into the capacitor means, and appropriate switching means can be adapted to select each level.

The selector means is configured to have a control switch to set the system to the desired light output level. Regardless of that setting, the selection means always allows sufficient current limiting for each lamp.

It is to be understood that if the selector switch is set to a low light output initially, there may be instances where the capacitance in each lamp circuit is too low to allow for optimal starting power for each lamp. If this occurs, the switching means can be adjusted to a higher light output which would in turn increase the current to each lamp to facilitate starting. Once a sufficient starting period has elapsed, the selector can be switched back to the lower light output level, which would result in the desired lower light output.

A timer device can be utilized to hold the system at a high capacitance for a set period each time the lamp or lamps are turned on. Then, according to the position of the control selector, upon end of the timing period, switching means are automatically operated to reduce the capacitance of the capacitor means for each lamp circuit if a level of dimming is selected. If full light output is desired, the capacitance remains the same.

Other optional enhancements can be utilized. For example, a timer element could be utilized to automatically dim all lamps after a set period of time has expired. An application would be with respect to tennis courts. If the lamps were set for full light output for one set of players, and the players neglected to turn the lamps to dim after they were done, the timer could automatically do so after a set period, for example, one hour. Such a system would save energy by reducing power consumption when full light output is not needed, yet at the same time provide a dimmed lighting output so that persons can have adequate lighting to walk and adequately see the courts. For example, in some instances, if an array of lights were dimmed to 20% light level output, it can realize as much as a 60% decrease in wattage or power needed to operate the lamps at that level. Even in the dimmed condition the lamps would be easily returned to their full power, full light output condition. This is in direct contrast to the conventional method of having the lights completely turn off and then having the required starting time to restart them.

The selection circuitry can be utilized to control one lamp, one array of lamps, or multiple arrays of lamps. Thus, the invention provides a simple, centralized way for controlling multi-level dimming of ballasted lamps.

It is to be understood that the invention can apply to a variety of different lighting arrangements and functions.

DETAILED DESCRIPTION OF THE PREFERRED EMBODIMENT

Figure 1:
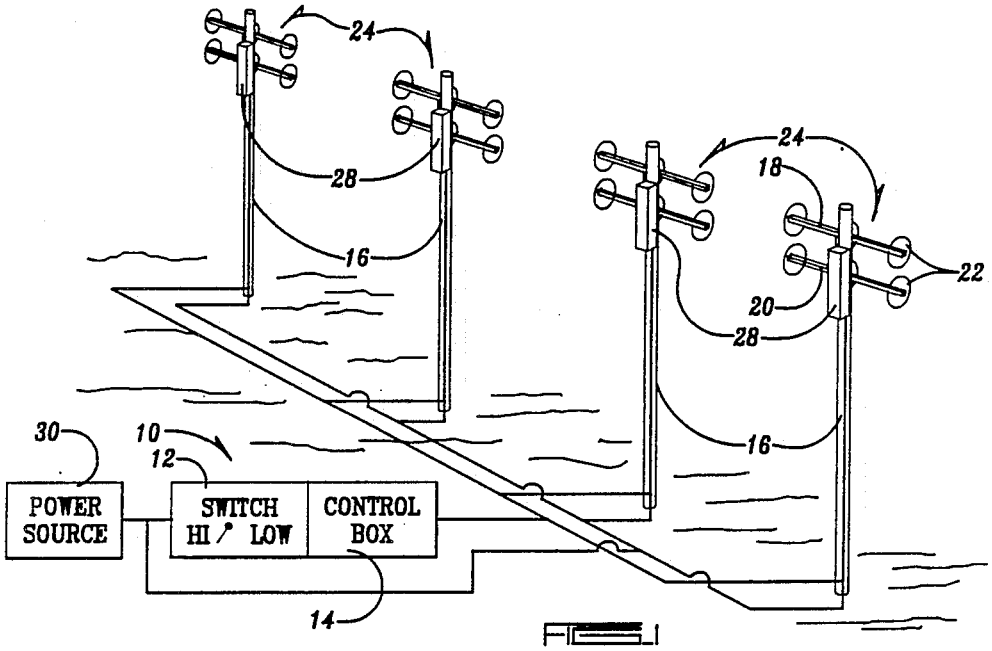
FIG. 1 is a combined perspective view and schematic view of one embodiment of lamps and lighting fixtures to which the invention could be applied.

With reference to the drawings, the preferred embodiments of the invention will now be described. Like parts or elements in the figures will sometimes be referred to by like reference numerals. This description is to aid in an understanding of the invention, but it is to be understood that it is not intended to limit the scope of the invention.

With reference to FIG. 1, control means 10 consists of a switch 12 and a control box 14. Four light poles 16 each have upper and lower crossarms 18 and 20 to which are mounted light fixtures 22. In FIG. 1, there are three light fixtures 22 per crossarm so that there are six light fixtures 22 for each light array 24 on each light pole 16.

Each light fixture 22 includes a lamp 26. Lamps 26 include, but are not limited to, long arc metal halide lamps, in the preferred embodiment. The invention may also apply to such lamps as high-pressure sodium lamps. It is necessary, however, that any lamp used must not have significant changes in lamp characteristics if capacitance of the lamp circuitry is changed. Each light pole 16 carries a ballast box 28.

It can be seen in FIG. 1 that electrical power source 30 introduces power into control means 10, and also separately into ballast boxes 28. In this embodiment switch 12 can be manually operated to select either a "high" setting or "low" setting, referring respectively to full and dimmed light output for each array 24 of lamps 26.

Control box 14 contains circuitry which facilitates the altering of the capacitance in each lamp circuit contained in each ballast box 28 to produce either maximum light output on "high" setting, or dimmed light output on "low" setting. Thus, a user can select light output for all four arrays 24 from one simple control.

If, for example, all four arrays 24 were lighting a horse racing track, switch 12 could be set for "high" during racing periods, and then switched to "low" for non-racing intervals. This would save power and also give an easy and universal signal to the customers of when the races will occur and are occurring.

Figure 2:
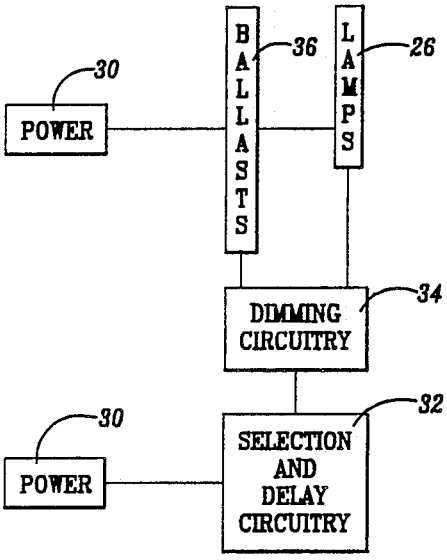
FIG. 2 is a diagrammatic view of one arrangement of the invention.

FIG. 2 gives a simple diagram for the basic components of the electrical circuitry utilized in one embodiment of the invention. The power source 30 would provide electrical power to ballasts 36, which in turn provide controlled electrical power to lamps 26. This conventional circuitry provides the constant starting voltage and operating power for lamps 26. Additionally, dimming circuitry 34 would be connected in parallel between ballasts 36 and lamps 26. It is to be understood that there would be a ballast 36 for each lamp 26, and a dimming circuitry for each ballast and lamp. Power source 30 would also provide power to selection and delay circuitry 32, which in turn would be connected to dimming circuitry 34. Selection and delay circuitry 32 could therefore control dimming for one or more arrays of lamps (such as shown in FIG. 1), or be used for only one or a few lamps.

In this arrangement, power from electrical power source 30 is supplied to a selection and delay circuitry 32 which includes a switch control for manual selection of a specific light output level. For example, selection could be between full light and dimmed light output. The selection and delay circuitry 32 would pass which light level was selected to dimming circuitry 34. Dimming circuitry 34 would be comprised of a variable capacitance means which could be adjusted according to desire. By altering capacitance of dimming circuitry 34, power to lamps 26 could be changed which in turn would alter their light output. Because dimming circuitry 34 does consist of a capacitance means, current limiting would also always be in place for each lamp 26.

It is to be understood that selection and delay circuitry 32 can include means for automatically insuring that the lamp circuitry (ballast 36, dimming circuitry 34, and lamp 26) is always set up initially for high light output (that is, high starting current). This is accomplished by using a delay timer to always hold dimming circuitry 34 in its high capacitance state for a certain pre-determined warm-up period each time lamps 26 are started. The delay timer would be powered by power source 30 and would override the selection switch until the end of the timing period. Once the period is over, the capacitance of dimming circuitry 34 will be controlled by the position of the selector switch.

Ballast 36 will always supply sufficient voltage for ignition and stable operation of lamps 26. The delay portion of selection and delay circuitry 32 would ensure adequate warm-up time for lamps 26. At the end of the timed interval, if the dimmed light level has been previously selected, circuitry 32 would automatically switch ballast 36 to low or dimmed output.

It is to be understood that the invention, in its preferred form, utilizes the fact that by changing the capacitance of the lamp circuit, light output from lamps 26 can be changed. Therefore, selection and delay circuit 32 basically consists of a switching means to switch between different values of capacitance in dimming circuitry 34 for each lamp 26.

Figure 3:
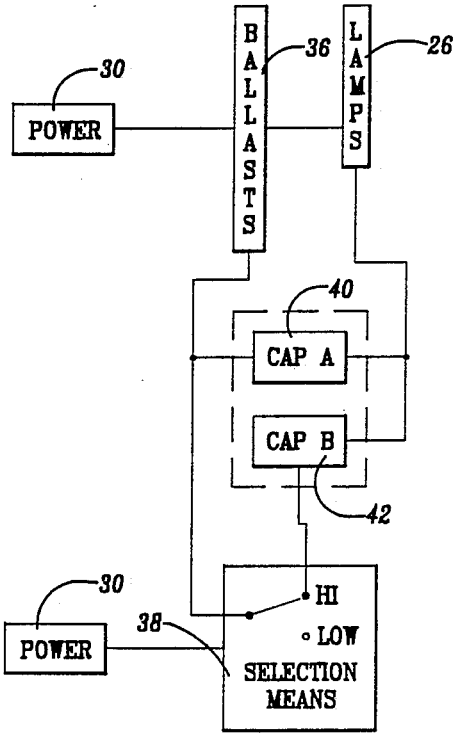
FIG. 3 is a diagrammatic view of another arrangement for the invention.

FIG. 3 depicts in general diagrammatic form, an alternative embodiment for the invention, as compared to FIG. 2. Again, the power source 30 is connected to ballasts 36. Electrical power is thus supplied through a ballast 36 to each lamp 26. In this embodiment, however, the selection and delay circuitry 32 of FIG. 2 is replaced by a two-position manual selection means 38 which basically consists of a manually operated switch which can be positioned in either the "hi" or "lo" positions. The "hi" position corresponds to high light output, whereas the "lo" position corresponds to low or dimmed light output.

In FIG. 3, dimming circuitry 34 of FIG. 2 is replaced specifically by two capacitors 40 and 42 connected in parallel. It can therefore be seen that selection means 38 determines whether only capacitor 40 will be in electrical communication in parallel between ballast 36 and lamp 26; or whether both the capacitors 40 and 42 will be in electrical connection and in parallel with ballast 36 and lamp 26.

It is again to be understood that in FIG. 3, there is a ballast 36 for each lamp 26, and there are parallel capacitors A and B for each such ballast 36 and lamp 26. Therefore, the selection means can operate dimming of multiple lamps or arrays of lamps (as depicted in FIG. 1), or can operate just one lamp.

In the preferred embodiment of FIG. 3, the switch of selection means 38 is normally in the closed (conducting) or "hi" position. Therefore, both capacitors 40 and 42 contribute capacitance to the lamp circuitry. Thus, in the normal position, both starting and operation of lamps 26 would be performed with the combined capacitance of capacitors 40 and 42. High or full light output would then emanate from lamps 26. It is to be understood, when discussing the embodiment of FIG. 3, that each lamp 26 would have a ballast 36 and parallel capacitors 40 and 42 available to it.

The circuitry of FIG. 3 therefore provides a specific method for altering capacitance of the lamp circuit to allow selection of full light output or dimmed light output. This arrangement does not include utilization of a delay timer. Selection means 38 can be a purely mechanical switch; or can utilize contactors or similar electrical actuating components, as desired. It is particularly useful for situations where the starting conditions for the lamps are controlled and the environment is generally constant. For example, such a system would work well for indoor lighting, such as a basketball court or gymnasium. Personnel could select full light output when desired, but switch to dimmed light output when desired. Such a system is less desirable for outdoor lighting where temperature and other environmental factors may make starting of the lamps difficult or impossible when the selector means 38 is switched to "lo" position. However, any such starting problem could be remedied by switching selector means 38 to the "hi" position.

Figure 4A:
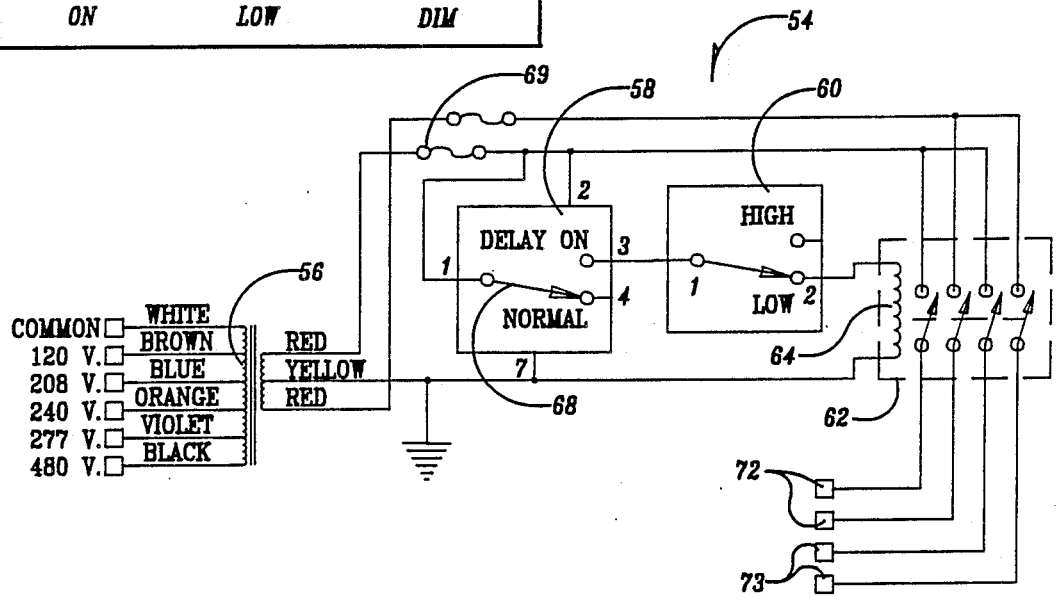
FIG. 4A is an electrical schematic of the selection and delay circuitry of FIG. 2 according to the invention.
Figure 4B:
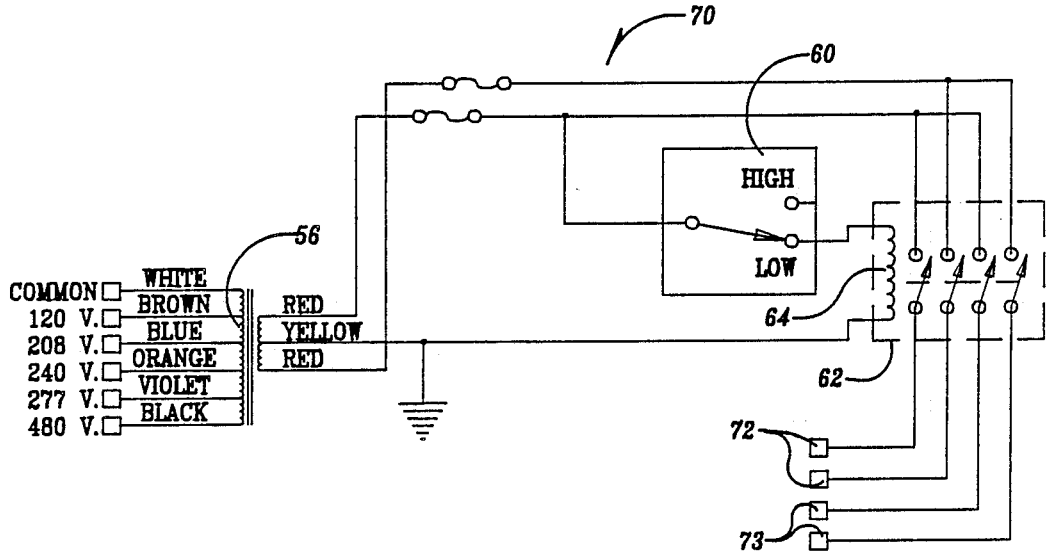
FIG. 4B is an electrical schematic of the selection means of FIG. 3 according to the invention.
Figure 5:
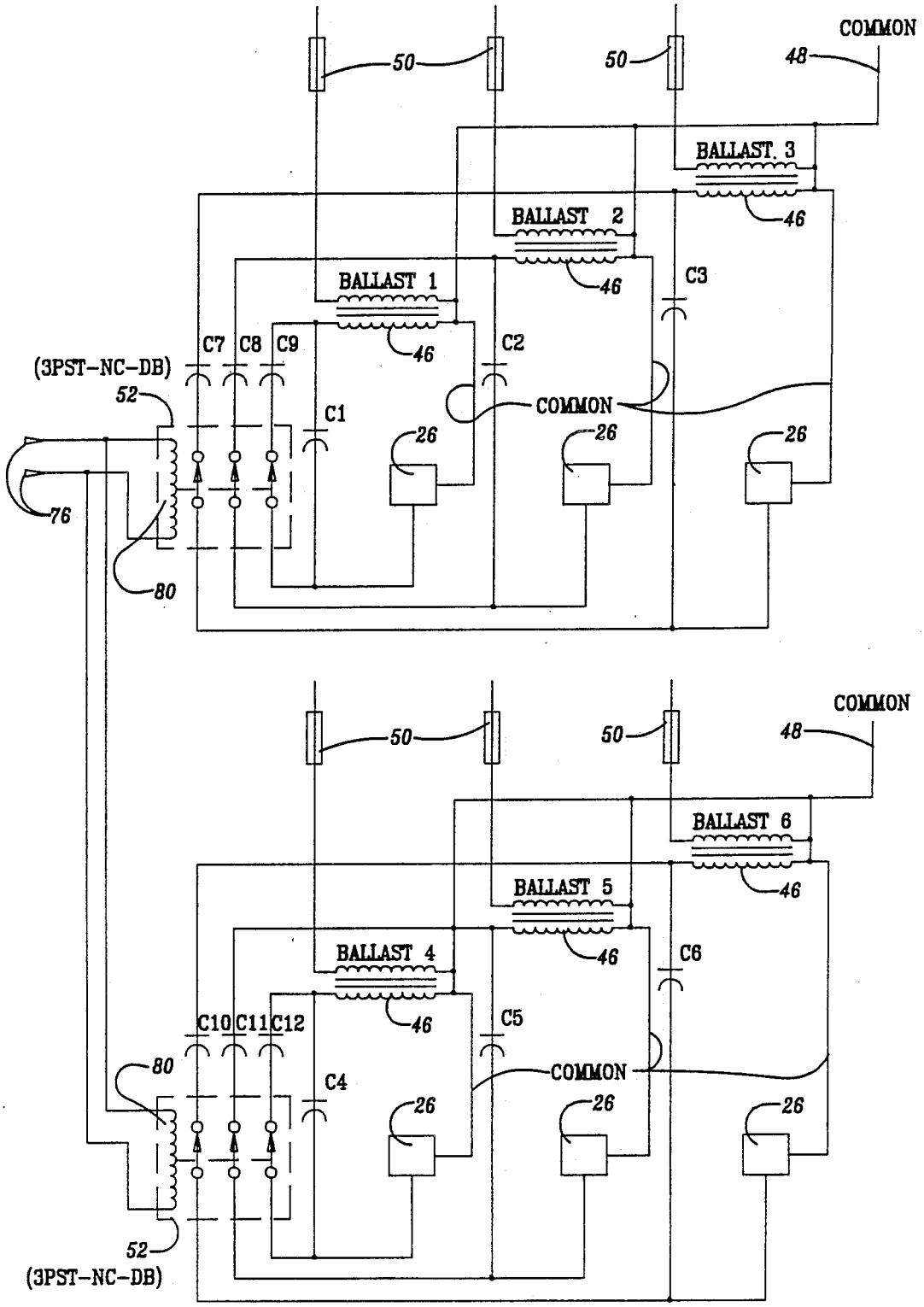

FIGS. 4 and 5 depict specific electrical schematics for embodiments of the invention. FIGS. 4A and 4B represent two alternative embodiments for the switching mechanisms to control dimming.

FIG. 4A, in combination with FIG. 5, provides a detailed electrical schematic and logic table for the embodiment of the invention depicted diagrammatically in FIG. 2. Two arrays of three lamps 26 are depicted in FIG. 5 for this example. Each lamp 26 always has a first capacitor (C1, C2, C3, C4, C5 or C6) connected in parallel to it. Power is provided to each lamp 26 and its attendant capacitor through transformer or ballast 46, which is connected to power source 30 and common ground 48. A power fuse 50 is connected in series between 46 and power source 30.

It can also be seen, however, in FIG. 5, that additional second capacitors C7, C8, C9, C10, C11, or C12, are each connected in parallel to each lamp 26, and its corresponding first capacitor C1, C2, C3, C4, C5, or C6. A three contact relay 52 (3PST-NC-DB, 30 A contacts, 115 V coil, available from Potter and Brumfield, product no. P30P46A13P1120) is integrated into the circuitry between second capacitors C7, C8, C9, and their corresponding lamps 26, and between second capacitors C10, C11, C12, and their corresponding lamps 26. These relays 52 are three pole single throw normally closed relays. Four pole relays (4PST-NC-DB) could also be used if desired. Therefore, unless relays 52 are energized, each lamp 26 has two capacitors in parallel with it at all times. Each capacitor pair for each lamp 26 thus is selected so that appropriate starting current is available to each lamp 26, and also high light output operation will be provided after starting of each lamp 26. The values of each of capacitors C1–C6, C7–C12 are selected such is well within the skill or knowledge of those with ordinary skill in the art.

Transformers 46 and corresponding capacitors C1–C6 and C7–C12 comprise the basic ballast circuits for each lamp 26. Thus, in FIG. 5, six basic ballast circuitries are depicted for each of the six lamps 26. Other numbers of lamps and attendant ballast circuitries could also be used. It is therefore to be understood that the above described circuitry would allow lamps 26 to be operated and ballasted for easy starting and high output operation.

Connected to relays 52 through electrical lines 76 are electrical lines 72 from what will be referred to as the selection circuitry 54 in FIG. 4A. Power is supplied to selection circuitry 54 from power source 30 through transformer 56. Power source 30 in the preferred embodiment consists of 120, 208, 240, 277, 480 VAC. Transformer 56 is a center tap 240 VAC transformer (Talema 0750-2-240 AM transformer). 240 VAC are used to operate the contacts of the system, whereas 120 VAC is utilized to operate the delay timer of FIG. 4A.

It can be seen that a delay time 58, a key switch 60, and a four contact relay 62 are connected in electrical communication in selection circuitry 54 of FIG. 4A.

Key switch 60 (Cutler Hammer 10250 T15113 key switch) has two positions, namely high and low, either of which can be selected by inserting the appropriate key, and turning the key cylinder to the desired setting. It can be seen that in the high position, the electrical pathway through key switch 60 is open (non-conducting); whereas in the low position, the electrical pathway through key switch 60 is closed (conducting). The output of key switch 60 is directly connected to the actuating core 64 of relay 62, and then returns to transformer 56.

Delay timer 58 also has two positions. The first position is normal as shown in FIG. 4A. Delay timer 58 is commercially available from conventional electrical component manufacturers (preferred embodiment utilizes Macromatic SS-50222-F10 Delay Timer, 10 minute; fixed time interval delay-on relay). Delay timer 58 operates by always resetting to the normal position when power is cut off to it. When power is first supplied to it, it includes a timer means which will hold switch arm 68 in the normal position until the elapsing of the set time period. At the end of that time, delay timer 58 will automatically change switch arm 68 to the "delay on" position which will provide an electrical pathway between the power source and key switch 60.

Delay timer 58 operates by electrical current flowing between pins 2 and 7 regardless of the position of switch arm 68. In the preferred embodiment, fuses 69 are placed in series between the power source and delay timer 58, and between the power source and relay 62.

Relay 62 is a four pole single throw normally open relay, as depicted in FIG. 4A. In the preferred embodiment relay 62 is a Potter and Brumfield P30P47A12P1-120. 4PST-NO-DM control contactor, 30 A contacts, 115 V coil. It can be seen that when power is first supplied to selection circuitry 54, delay timer 58 would have switch arm 68 in the "normal" position, which is basically an open non-conducting path. Regardless of placement of key switch 60, delay timer 58 would count the preset time period and no current would be supplied through key switch 60. Furthermore, no current would be supplied to actuating core 64 of relay 62, or through the four poles of relay 62.

At the expiration of the time period of delay timer 58, switch arm 68 would automatically be positioned to the "delay on" position and an electrical pathway would be formed to key switch 60. It is to be understood that simultaneous with power being given to selection circuitry 54, full starting power would also be provided to each ballast transformer 46 for each lamp 26. Thus, during the timing period of delay timer 58, lamps 26 would be given sufficient time and power to start. This is facilitated by the fact that the two capacitors for each lamp 26 would be connected in parallel to each lamp 26, because relays 52 are normally closed (See FIG. 5). This cumulative capacitance and capacitive reactance gives the necessary starting power for the lamps.

Again at the end of the timing period of delay timer 58, if key switch 60 is in the "low" position, an electrical pathway would be closed (conducting state) up to actuate actuating core 64 of relay 62. Upon this occurrence, normally open relay 62 would have each of its four poles closed. Thus as can be seen in FIGS. 4A and 5, connections 72 (FIG. 4A) would be connected from selection circuitry 54 of FIG. 4A to connections 76 (FIG. 5) of the typical lamp circuits of FIG. 5. Likewise, connections 73 of the selection circuitry 54 would be available to be electrically connected to additional lamp circuits, if desired or needed. Electrical power would then be supplied to actuating core 80 of relay 52 which would open the three poles of relay 52. This would reduce the capacitance of each lamp 26 by removing capacitors C7, C8, C9. The drop in capacitance and capacitive reactance would then cause the lowering of light output from lamps 26 to dim those lights. However, ballasts 46 would still function to stably and reliably operate lamps 26 at their dimmed and lower power output.

In the other situation, if the key switch 60 of selection circuitry 54 is initially set at "high", it simply maintains an open (non-conducting) circuit to relay 62. Thus, when power is supplied to selection circuitry 54 and lamps 26, and they are initially turned on, delay timer 58 will still begin in the "normal" position and switch to the "delay on" after the timing period is done. However, relay 62 will not be energized because there is no electrical pathway to it through key switch 60. Thus, all lamps 26 will operate normally in their high output capacity.

It can therefore be seen that selection circuitry 54 not only allows desired selection of high light output or dimmed light output, it also insures that there will always be sufficient starting voltage to lamps 26 when they are initially turned on.

Once the timing period for delay timer 58 has expired, key switch 60 can be changed between "high" and "low" according to desire, and as many times as desired. Thus, if high output from lamps 26 is desired for a period of time, and then dimming is desired, the key switch is simply turned to "low". Lamps 26 will immediately reduce their light output to the dimmed level. If high light output is then needed key switch 60 is then returned to "high" and the lamps 26 will increase light output back up to the high level.

FIG. 4A includes a logic chart showing the different possible status of relay 52, key switch 60, and lamps 26. In the preferred embodiment, lamps 26 are long-arc mercury halide lamps which are well known in the art and require ballasting.

FIG. 4A also shows that a number of lamp arrays can be controlled by selection circuitry 54. One selection circuitry 54 of FIG. 4A can control up to four sets of three lamps 26 each. By using different electrical power levels and components, less or more lamps 26 can be controlled by one selection circuitry 54. It can therefore be seen that the invention can control dimming of a plurality of arrays of light fixtures, at spaced apart locations, such as shown generally in FIG. 1.

It is again further to be understood that the invention can be applied to multilevel dimming. This would require additional parallel capacitors to be added to each lamp and ballast circuit in a switched relationship. Thus, a key switch with multiple selections could be used and control operation of relays to corresponding relays for each level of capacitors. Similar operation of the selection circuitry 54, and in particular, delay timer 58, would be used to insure that there is always sufficient starting voltage for lamps 26.

FIG. 4B depicts the selection circuitry 70 for an alternative to the embodiment of the present invention shown in FIG. 4A. Selection circuitry 70 would work with lamps 26, ballasts 46, and capacitors C1–C12, as shown in FIG. 5. Additionally, relays 52 would be utilized. The embodiment of selection circuit 70 of FIG. 4B simply is one detailed electrical schematic of the diagrammatic circuitry shown in FIG. 3. A manual high and low switch like key switch 60 of FIG. 4 would be utilized to supply current to core 64 of relay 62 to operate relay 62. As can be seen, switch 60 therefore can alter the capacitance of each lamp circuit to control whether the lamps are on full light output or dimmed light output. The embodiment of FIG. 4B differs from that of FIG. 4A only in that it does not include delay timer. The switch is completely manually controlled. All else functions the same as has been previously described with respect to FIGS. 4A and 5.

It can therefore be seen that the invention meets at least all of its stated objectives. The included preferred embodiment is given by way of example only, not by way of limitation to the invention, which is solely described by the claims herein. Variations obvious to one skilled in the art will be included within the invention defined by the claims.

What is claimed is:

1. A dimming means for ballasted lamps comprising:

one or more lamp means;

ballast means operatively connected to each lamp means for ballasting the lamp means to provide stable starting and operating power to the lamp means;

the ballast means including variable capacitor means operatively connected between the ballast means and the lamp means; and control means operatively connected to all variable capacitor means for altering the capacitance of the capacitor means to vary operating power to each lamp means to allow dimming of all lamp means.

2. The dimming means of claim 1 wherein the lamp means comprises a long arc metal halide lamp.

3. The dimming means of claim 1 wherein the lamp means comprise a high pressure sodium lamp.

4. The dimming means of claim 1 wherein the ballast means includes a transformer means.

5. The dimming means of claim 1 wherein the control means includes a normally open switch.

6. The dimming means of claim 1 wherein the capacitor means comprises an electrical component having different levels of capacitance.

7. The dimming means of claim 6 wherein the capacitor means comprises first and second capacitors connected in parallel to each other.

8. The dimming means of claim 1 wherein the control means includes a time delay means for holding the variable capacitor means in a higher capacitance condition during a predetermined time period upon each actuation of the lamp means.

9. The dimming means of claim 1 wherein the control means includes a timer means for automatically switching the variable capacitor means to a lower capacitance setting upon expiration of a predetermined time period.

10. The dimming means of claim 1 wherein the dimming means is applied to a plurality of lamp means.

11. The dimming means of claim 1 wherein the control means includes a contactor relay means which is connected with the lamp means, and which is non-conducting when the control means is in a higher capacitance position.

12. A dimming method for one or more ballasted lamps comprising:

connecting a variable capacitance means between a ballast means and a lamp means for each lamp; and decreasing the capacitance of the capacitor means to decrease electrical power to the lamp means to dim all lamp means, if desired, by utilizing a single control means to operate all variable capacitance means.

13. The dimming method of claim 12 wherein the electrical power to the lamp means is decreased by reducing capacitance of the variable capacitance means.

14. The dimming method of claim 13 wherein the variable capacitance means comprises first and second capacitors in parallel.

15. The dimming method of claim 14 wherein capacitance is reduced by disconnecting the electrical pathway to one of the capacitors.

16. The dimming method of claim 12 whereby selection between normal and dimmed light output is accomplished by manually operating a control switch associated with the control means.

17. The dimming method of claim 12 whereby selection between normal and dimmed light output is accomplished by an automatically operating timer means associated with the control means.

18. The dimming method of claim 13 wherein multiple dimming levels are accomplished by incrementally decreasing electrical power to the lamp means.

19. The dimming method of claim 12 wherein full capacitance of the variable capacitance means is always provided to the lamp means for a preselected time period when starting the lamp means.

20. The dimming method of claim 19 further comprising reducing the capacitance of the capacitor means upon expiration of the preselected time period.

21. A dimming means for ballasted lamps comprising:

a plurality of lamp means;

ballast means operatively connected to each lamp means;

capacitor means operatively connected between each lamp means and corresponding ballast means;

the capacitor means comprising first and second capacitors in parallel with each other;

switch means connected in series with one of the capacitor means, the switch means being normally closed; and a single control means connected to all switch means for controlling opening of all switching means for one of the capacitors to reduce the capacitance of the capacitor means when desired.

22. The dimming means of claim 21 wherein the switching means is a contactor means.

23. The dimming means of claim 21 wherein the plurality of lamp means comprises one or more arrays of lamps.

24. The dimming means of claim 21 wherein the control means comprises a relay means.

25. A dimming means for ballasted lamps comprising:

two or more sets of high power lamps;

a ballasting means operatively connected to each lamp of each set;

a variable capacitance means operatively connected between each ballasting means and its corresponding lamp;

a high voltage switching means operatively connected to each variable capacitance means to switch capacitance levels of the variable capacitance means; and a control means operatively connected to all switching means to control switching of all switching means.

26. A dimming means for ballasted lamps comprising:

one or more lamp means;

ballast means operatively connected to each lamp means for ballasting the lamp means to provide stable starting and operating power to the lamp means;

the ballast means including variable capacitor means operatively connected between the ballast means and the lamp means; and control means operatively connected to all variable capacitor means for altering the capacitance of the capacitor means to vary operating power to each lamp means to allow dimming of all lamp means, the control means including a time delay means for holding the variable capacitor means in a higher capacitance condition during a predetermined time period upon each actuation of the lamp means.

27. A dimming means for ballasted lamps comprising:

one or more lamp means;

ballasted means operatively connected to each lamp means for ballasting the lamp means to provide stable starting and operating power to the lamp means;

the ballast means including variable capacitor means operatively connected between the ballast means and the lamp means; and control means operatively connected to all variable capacitor means for altering the capacitance of the capacitor means to vary operating power to each lamp means to allow dimming of all lamp means, the control means including a timer means for automatically switching the variable capacitor means to a lower capacitance setting upon expiration of a per-determined period.

28. A dimming means for ballasted lamps comprising:

one or more lamp means;

ballast means operatively connected to each lamp means for ballasting the lamp means to provide stable starting and operating power to the lamp means;

the ballast means including variable capacitor means operatively connected between the ballast means and the lamp means;

control means operatively connected to all variable capacitor means for altering the capacitance of the capacitor means to vary operating power to each lamp means to allow dimming of all lamp means; and relay means connected with each lamp means, the relay means being nonconducting when the control means is in a higher capacitance position.

29. A dimming method for one or more ballasted lamps comprising:

connecting a variable capacitance means between a ballast means and a lamp means for each lamp;

decreasing the capacitance of the capacitor means to decrease electrical power to the lamp means to dim all lamp means, if desired, by utilizing a single control means to operate all variable capacitance means; and selecting between normal dimmed light output utilizing an automatically operating timer means associated with the control means.

30. A dimming method for one or more ballasted lamps comprising:

connecting a variable capacitance means between a ballast means and a lamp means for each lamp;

decreasing the capacitance of the capacitor means to decrease electrical power to the lamp means to dim all lamp means, if desired by utilizing a single control means to operate all variable capacitance means; and providing full capacitance of the variable capacitance means to the lamp means for a preselected time period when starting the lamp means.

31. The dimming method of claim 30 further comprising:

reducing the capacitance of the capacitor means upon expiration of the preselected time period.

* * * * *